US005919344A

United States Patent [19]

d'Erasmo et al.

[11] Patent Number: 5,919,344

[45] Date of Patent: Jul. 6, 1999

[54] DIAPHRAGM ELEMENT FOR AN ELECTROLYTIC FILTER PRESS ASSEMBLY

[75] Inventors: Pietro d'Erasmo, Notodden; Roger Mareno Lysfjord, Stathelle, both of Norway

[73] Assignee: Norsk Hydro ASA, Oslo, Norway

[21] Appl. No.: 08/981,409

[22] PCT Filed: Jun. 19, 1996

[86] PCT No.: PCT/NO96/00152

§ 371 Date: Apr. 8, 1998

§ 102(e) Date: Apr. 8, 1998

[87] PCT Pub. No.: WO97/00979

PCT Pub. Date: Jan. 9, 1997

[30] Foreign Application Priority Data

Jun. 23, 1995 [NO] Norway ..... 952528

[51] Int. Cl.[6] ..... C25B 13/00

[52] U.S. Cl. ..... 204/295; 204/252

[58] Field of Search ..... 204/263, 265, 204/266, 295, 296, 257, 258, 252

[56] References Cited

U.S. PATENT DOCUMENTS

| | | | |
|---|---|---|---|
| 1,508,758 | 9/1924 | Allan . | |
| 3,902,984 | 9/1975 | Yoshida et al. | 204/254 |
| 4,252,628 | 2/1981 | Boulton et al. | 204/257 |
| 4,268,373 | 5/1981 | Iijima et al. | 204/252 |
| 4,915,803 | 4/1990 | Morris | 204/263 |
| 4,927,509 | 5/1990 | Mathur et al. | 204/83 |
| 5,064,514 | 11/1991 | Cawlfield et al. | 204/263 |
| 5,421,977 | 6/1995 | Getsy et al. | 204/263 |

FOREIGN PATENT DOCUMENTS

| | | |
|---|---|---|
| 1212354 | 10/1986 | Canada . |
| 0 158 760 | 10/1985 | European Pat. Off. . |
| 0 545 548 A1 | 6/1993 | European Pat. Off. . |
| 631138 | 12/1927 | France . |
| 312582 | 3/1956 | Switzerland . |

*Primary Examiner*—Bruce F. Bell

*Attorney, Agent, or Firm*—Wenderoth, Lind & Ponack, L.L.P.

[57] ABSTRACT

The present invention relates to diaphragm elements for an electrolytic filter press assembly comprising anode and cathode compartments separated with diaphragms. The diaphragm elements comprise a frame (1) which is rigid steel covered by a flexible vulcanizable material (6) serving as electrical insulation and simultaneously sealing and being integrated with fastening device (4) with openings (7) for bolts for securing the diaphragm (12) to the frame (1). T-formed elements (2,3) form gas/liquid channels with the frame (1) and are secured to it by bolts (5) and covered by material (6) integral with the sealing/insulating material (6) around frame (1).

6 Claims, 2 Drawing Sheets

Section A-A

Section A-A

DIAPHRAGM ELEMENT FOR AN ELECTROLYTIC FILTER PRESS ASSEMBLY

This application is a 371 of PCT/NO96/00152 filed Jun. 19, 1996.

BACKGROUND OF THE INVENTION

The present invention relates to diaphragm elements in an electrolytic filter press assembly comprising anode and cathode compartments separated by diaphragms. The diaphragm elements comprise a frame, openings for the flow of gas and liquids, respectively, a diaphragm secured to the frame, sealing means and insulating means.

The electrolytic filter press assembly is primarily used for the production of hydrogen and oxygen from brines, usually aqueous alkali hydroxide solutions. Similar cells are used for the production of chlorine from sodium chloride solutions. Such cells can comprise steel frames or frames made of plastic materials. One advantage of using steel frames is that they are rigid, and large filter press assemblies can then be made. However, steel frames necessitate insulation and sealing devices between the frames. Corrosion is also a problem to be dealt with. One way of dealing with the corrosion problem is the nickel plating of, for instance, the surfaces of the diaphragm elements that are exposed to the brine or lye to be electrolyzed. But nickel plating is expensive and should be kept to a minimum.

Electrolyzers of the above type have been known for a long time and are described in numerous patens. In Norwegian patent No. 157024 there is described an electrolyzer of the filter press type for production of hydrogen and oxygen. Each cell consists of bipolar electrodes separated from each other by a diaphragm element. The cells are kept together between two end plates in such a way that the electrolytic cells are kept under constant pressure by longitudinal bolts between the plates. In the electrolyzer's longitudinal direction, and at its upper part, respective channels for hydrogen and oxygen, are made in the cells. At the lower part of the cells are channels for circulating lye.

From EP 0212240 A1 there is known an apparatus for electrolysis of solutions comprising bipolar elements made up of a conductive plate peripherally surrounded by an insulating frame provided with feeding and discharging channels along peripheral zones of the frame itself. Separating elements can be inserted between the bipolar elements, consisting of a porous diaphragm and an insulating frame also carrying feeding and discharging channels.

SUMMARY OF THE INVENTION

The main object of the invention was to arrive at a new diaphragm element construction comprising the application of steel frames such that large rigid dimensions could be achieved and at the same time attain a construction giving a simpler construction of electrolyzers having fewer elements than present ones.

Another object was to arrive at a common arrangement for sealing, electrical insulation and protection against corrosion.

The main problem the inventors had to solve was the corrosion of the steelparts of the diaphragm element and how new and improved sealing and insulating means could be applied without making more complicated and expensive elements. During the development of new solutions to the problem it was found that the corrosion problem could be solved by conventional nickel plating of only minor parts of the diaphragm element and then covering the remaining exposed parts with a corrosion resistant material, for instance plastic or rubber material. Keeping in mind that the diaphragm element also had to be electrically insulated along its circumference, the inventors started investigating the possibility of using the same material for corrosion protection, insulation and sealing. It was then found that not only could the same material be used, but by doing this it became possible to make a more simple and cheap diaphragm element. This was achieved by integrating the corrosion protecting coating of the steel parts of the element with the electrical insulation and the sealing of the diaphragm element.

Useful materials for making these integrated corrosion and insulating coatings were found to be vulcanizable rubber having the required electrical insulating and sealing properties.

By applying the above described principle, only minor parts had to be nickel plated and this could be performed with small nickel plating equipment. It was further found that some of the various elements of the diaphragm element did not have to be joined by welding as previously, but could simply be kept in place with the vulcanized rubber coating. Thus welding could to a great extent be substituted by vulcanization.

The main new features of the invention are that the frame 1 is rigid steel covered by a flexible, vulcanizable material 6 serving as electrical insulation and simultaneously sealing and being integrated with fastening means 4 with openings 7 for bolts for securing the diaphragm 12 to the frame 1.

Another special feature of the invention is that T-formed elements 2,3 form gas/liquid channels with the frame 1 and are secured to the frame by bolts 5 and covered by material 6, which is integral with the sealing/insulating material 6 around the frame 1.

Preferably diaphragm 12 is secured to element 2 by a nickel plated element 10 and to element 3 and the frame 1 by means of fastening means 4 as an integral part of the insulating/sealing material 6.

BRIEF DESCRIPTION OF THE DRAWINGS

The invention will now be further explained in connection with the description of the drawings.

DETAILED DESCRIPTION OF A PREFERRED EMBODIMENT

Figure 1:
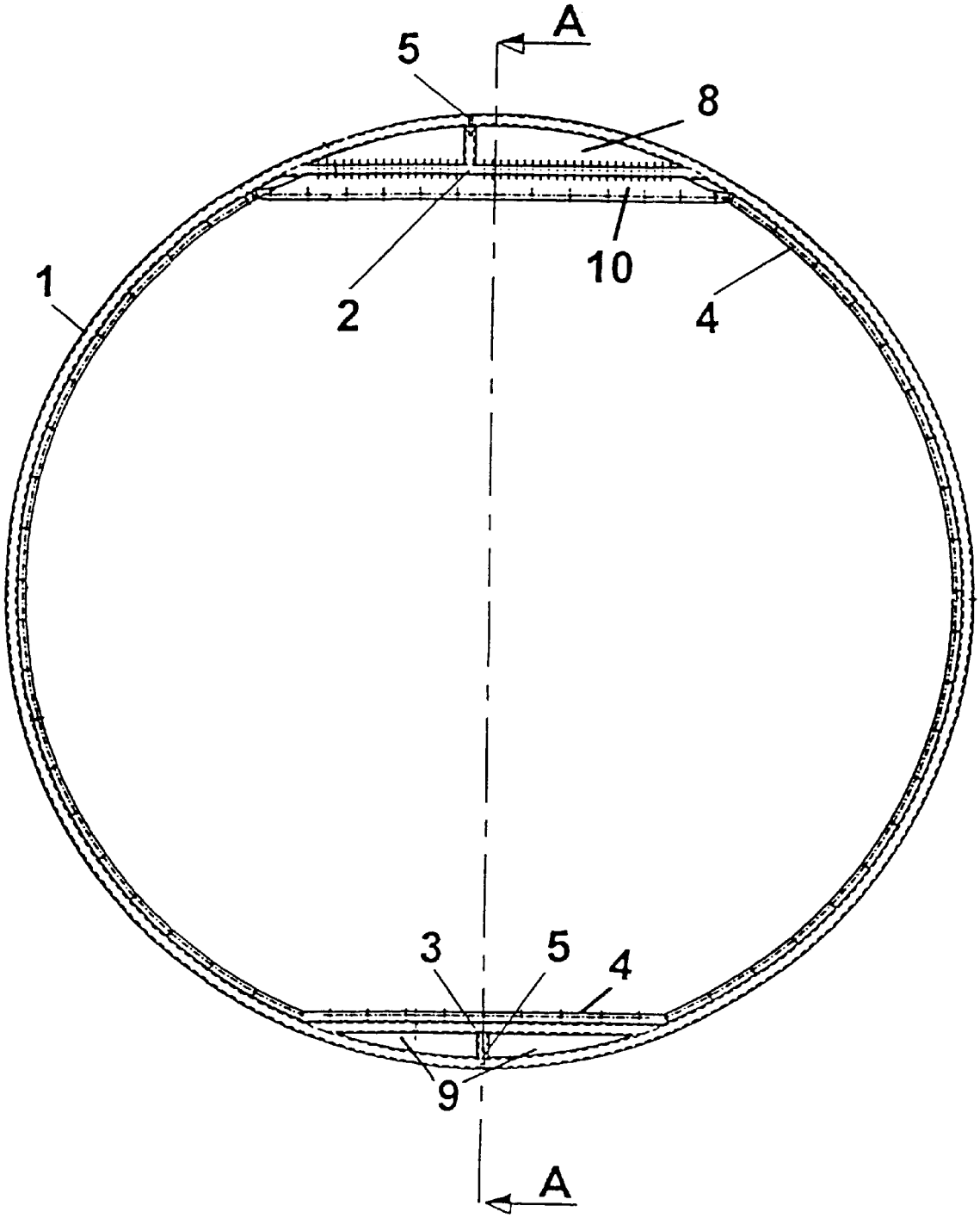
FIG. 1 shows a front view of a diaphragm element according to the invention.

FIG. 1 shows a circular shaped diaphragm element, though the shape can also be rectangular or square. The outer frame of the element is a rigid steel frame 1 covered by an electrically insulating material 6, which also serves as a sealant, and which is integral with fastening means 4 with openings 7 by which the diaphragm itself is fastened to the fastening means 4. T-formed elements 2 and 3 are secured to the frame 1 for forming respective gas channels 8 and lye channels 9. The T-formed elements 2 and 3 are kept in position by bolts 5 when the material 6 is brought onto the elements, which thereby are secured to be gas and liquid impervious. These elements are covered by the material 6, which is vulcanized to the elements. The elements 2 and 3 have respective fastening means 10, 4 by which the diaphragm itself is secured to these elements. Fastening means 10 are nickel plated.

Figure 2:
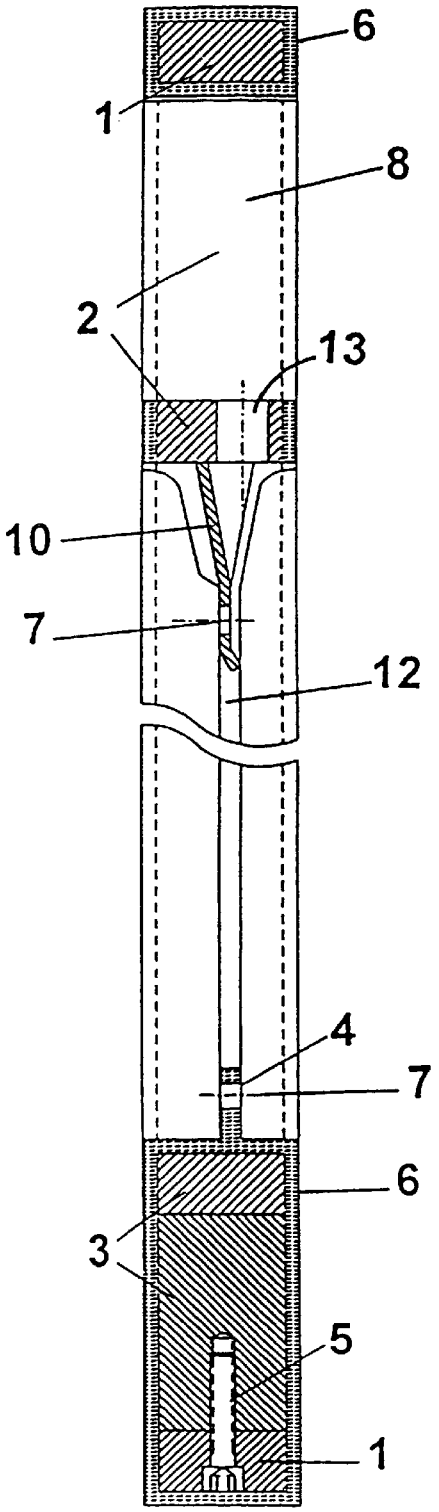
FIG. 2 shows a cross section of the diaphragm element of FIG. 1 along line A—A

In FIG. 2 the cross section of the diaphragm element is shown taken along line A—A of FIG. 1. The cross section goes right through the T-formed element 3, and the lye channel 9 can accordingly not be seen on this figure. The diaphragm 12 is secured by bolts through the openings 7 to the fastening means 4 and 10. The latter is nickel plated, while the former constitutes an integral part of the material covering the steel frame 1. The opening 13 in element 2 is a gas passage from the electrolytic cell to the gas channel 8.

Figure 3:
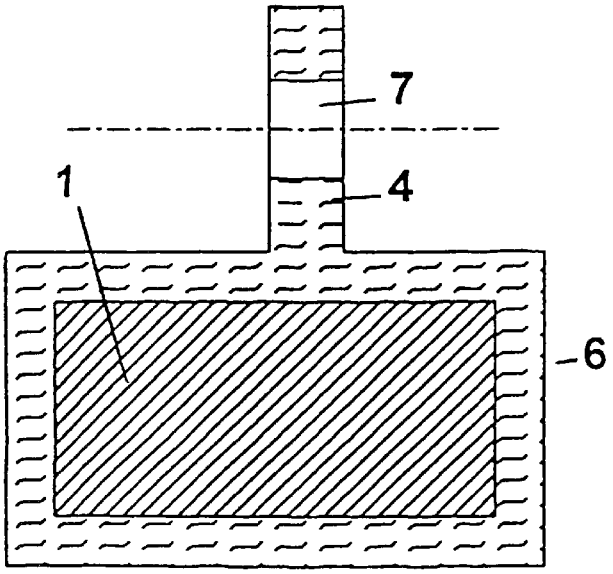
FIG. 3 shows a cross section of the frame with insulation and sealant.

FIG. 3 is a cross section of the circular frame and shows the steel frame 1 covered by the insulating and sealing material 6 and the integral fastening means 4 made of the same material. The opening 7 is for the bolts which shall secure the diaphragm to the fastening means 4.

By the present invention numerous advantages have been obtained compared with existing solutions. The production costs have been substantially reduced as most of the nickel plating is substituted with vulcanization. As today's nickel plating requires expensive and large chemical baths, the production costs have been substantially reduced, as most of the nickel plating is substituted with vulcanization. The electrolyzer will be more compact, and the advantages of using the same material for corrosion protection, electrical insulation and will sealing will be of great value and simplify the material requirements for the electrolyzer.

We claim:

1. A diaphragm element for an electrolytic filter press assembly which has anode and cathode compartments separated by a diaphragm, said diaphragm element comprising:

a rigid steel frame completely covered with a flexible vulcanizable material which serves as electrical insulation and as sealant;

a fastening arrangement integrated with said flexible vulcanizable material, said fastening arrangement having bolt openings therein for securing the diaphragm to said rigid steel frame; and T-shaped elements secured to said rigid steel frame by bolts and forming gas and liquid channels with said rigid steel frame, said T-shaped elements being covered by said flexible vulcanizable material.

2. The diaphragm element of claim 1, and further comprising a nickel plated fastening element for securing the diaphragm to one of said T-shaped elements.

3. A diaphragm element comprising:

a rigid steel frame covered with flexible vulcanizable material which serves as electrical insulation and sealant;

a fastening arrangement which is defined by said flexible vulcanizable material so as to be integral therewith, said fastening arrangement having bolt openings therein; and T-shaped elements secured to said rigid steel frame by bolts and forming gas and liquid channels with said rigid steel frame, said T-shaped elements being covered by said flexible vulcanizable material.

4. The diaphragm element of claim 3, wherein a diaphragm is secured to one of said T-shaped elements and to said rigid steel frame by said fastening arrangement, and further comprising a nickel plated fastening element securing said diaphragm to another of said T-shaped elements.

5. A diaphragm element for an electrolytic filter press assembly which has anode and cathode compartments separated by a diaphragm, said diaphragm element comprising:

a rigid steel frame completely covered with a flexible vulcanizable material which serves as electrical insulation and as sealant;

T-shaped elements secured to said rigid steel frame by bolts and forming gas and liquid channels with said rigid steel frame, said T-shaped elements being covered by said flexible vulcanizable material; and a fastening means for fastening a diaphragm to said rigid steel frame and to said T-shaped elements, said fastening means comprising a portion integrated with said flexible vulcanizable material, said portion having bolt openings therein for securing the diaphragm to said rigid steel frame.

6. The diaphragm element of claim 5, wherein said fastening means further comprises a nickel plated fastening element for securing the diaphragm to one of said T-shaped elements, said portion securing said diaphragm to another of said T-shaped elements and said rigid steel frame.

* * * * *